US008441200B2

(12) United States Patent
Busse et al.

(10) Patent No.: US 8,441,200 B2
(45) Date of Patent: May 14, 2013

(54) ELECTRONIC BALLAST AND METHOD FOR OPERATING AT LEAST ONE FIRST AND SECOND DISCHARGE LAMP

(75) Inventors: Olaf Busse, Munich (DE); Siegfried Mayer, Moosinning (DE); Arwed Storm, Dachau (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 218 days.

(21) Appl. No.: 12/741,833

(22) PCT Filed: Nov. 9, 2007

(86) PCT No.: PCT/EP2007/062117

§ 371 (c)(1), (2), (4) Date: May 7, 2010

(87) PCT Pub. No.: WO2009/059643

PCT Pub. Date: May 14, 2009

(65) Prior Publication Data

US 2010/0237791 A1 Sep. 23, 2010

(51) Int. Cl.
*H05B 37/02* (2006.01)

(52) U.S. Cl.
USPC ..... 315/226; 315/241 R; 315/244; 315/283; 315/307; 315/DIG. 7

(58) Field of Classification Search ..... 315/209 R, 315/210, 224–226, 241 R, 244, 246, 250, 315/283, 291, 307, 308, DIG. 7
See application file for complete search history.

(56) References Cited

U.S. PATENT DOCUMENTS

| | | | | |
|---|---|---|---|---|
| 4,538,093 | A * | 8/1985 | Melai | 315/219 |
| 5,309,062 | A * | 5/1994 | Perkins et al. | 315/53 |
| 5,945,788 | A | 8/1999 | Li et al. | |
| 6,104,146 | A | 8/2000 | Chou et al. | |
| 7,132,803 | B2 * | 11/2006 | Shackle et al. | 315/224 |
| 7,528,558 | B2 * | 5/2009 | Yu et al. | 315/308 |

(Continued)

FOREIGN PATENT DOCUMENTS

| | | | |
|---|---|---|---|
| DE | 102004037389 | B4 | 5/2008 |
| EP | 1337133 | A2 | 8/2003 |
| EP | 1871147 | B1 | 9/2009 |
| WO | 2008037290 | A1 | 4/2008 |

OTHER PUBLICATIONS

International Search Report of PCT/EP2007/062117 mailed on Oct. 15, 2008.
English-language abstract of DE 10 2004 037 389 B4.

(Continued)

*Primary Examiner* — Thuy Vinh Tran

(57) ABSTRACT

An electronic ballast for operating at least two discharge lamps is provided, which may include a starting detection apparatus for detecting whether one of the discharge lamps has been started; wherein a drive circuit includes an input, which is coupled to a starting detection apparatus, wherein a threshold value entry apparatus is designed to enter a second threshold value for a setpoint value of a total current through at least two inductances, wherein the second threshold value has a smaller magnitude than a first threshold value; and wherein the drive circuit is designed to drive a first electronic switch and a second electronic switch taking into consideration the first threshold value as setpoint value prior to detection of the starting of a discharge lamp by the starting detection apparatus, and taking into consideration the second threshold value as setpoint value.

9 Claims, 1 Drawing Sheet

U.S. PATENT DOCUMENTS

| | | | | |
|---|---|---|---|---|
| 2003/0151378 | A1 | 8/2003 | Busse et al. | |
| 2005/0156534 | A1* | 7/2005 | Oh | 315/247 |
| 2005/0184685 | A1* | 8/2005 | Sekine et al. | 315/312 |
| 2007/0103093 | A1 | 5/2007 | Hagen et al. | |

OTHER PUBLICATIONS

English-language abstract of EP 1 871 147 B1.

* cited by examiner

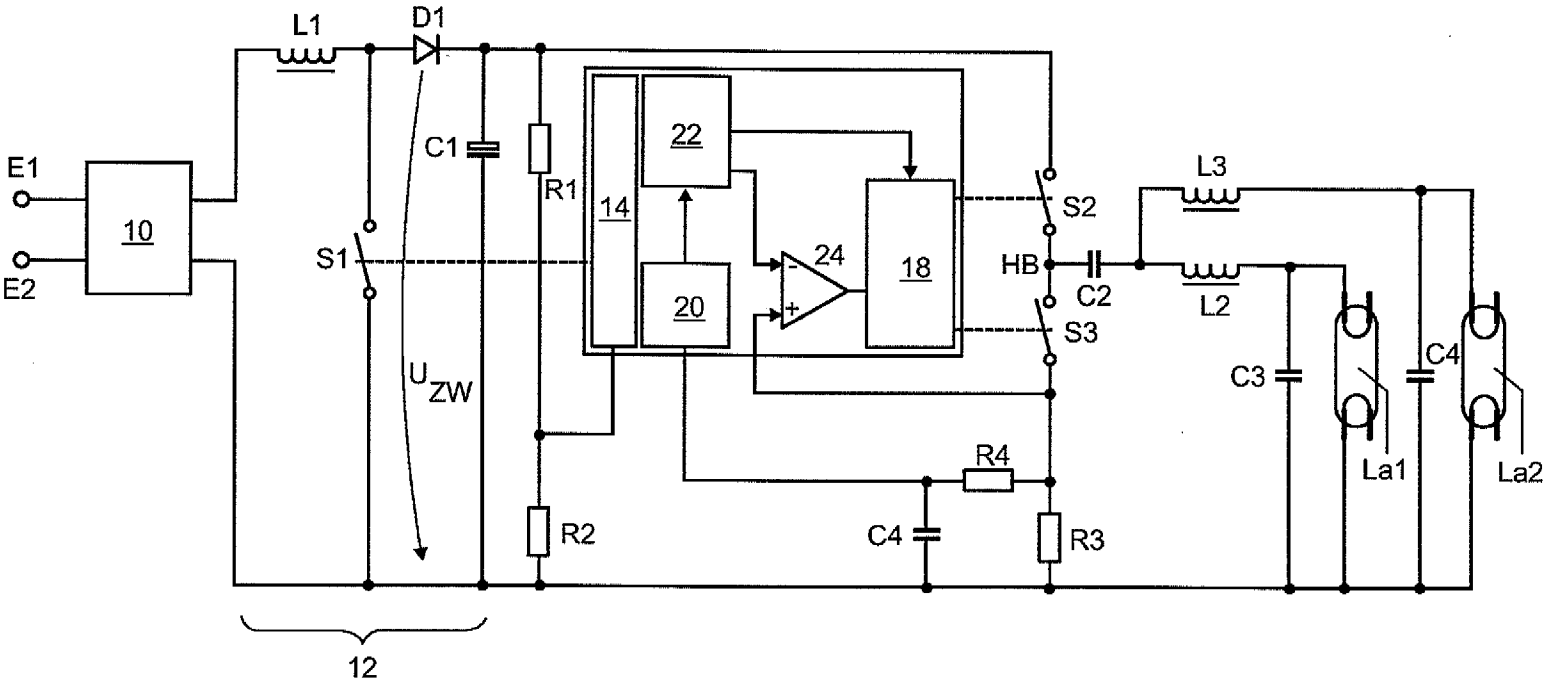
La2
C4
La1
C3
L3
L2
C2
S2
S3
HB
R3
R4
C4
18
24
22
20
14
R1
R2
C1
D1
$U_{ZW}$
S1
L1
12
10
E1
E2

ELECTRONIC BALLAST AND METHOD FOR OPERATING AT LEAST ONE FIRST AND SECOND DISCHARGE LAMP

RELATED APPLICATIONS

The present application is a national stage entry according to 35 U.S.C. §371 of PCT application No.: PCT/EP2007/062117 filed on Nov. 9, 2007.

TECHNICAL FIELD

Various embodiments relate to an electronic ballast for operating at least a first discharge lamp and a second discharge lamp with a bridge circuit, which includes at least a first electronic switch and a second electronic switch, wherein the input at the bridge circuit is coupled to a DC supply voltage, wherein the output of the bridge circuit is coupled to a first terminal for a first discharge lamp and a second terminal for a second discharge lamp, wherein the first terminal and the second terminal are connected in parallel with respect to the output of the bridge circuit, at least a first starting apparatus and a second starting apparatus which each include an inductance which is arranged in series with the respective discharge lamp, and a capacitance, which is arranged in parallel with the respective discharge lamp, a current measuring apparatus, which is designed to provide a signal as its output, said signal being correlated with the actual value of the total current through the at least first inductance and second inductance, as well as a drive circuit. The latter has at least a first output and a second output for driving at least the first electronic switch and the second electronic switch, a first input, which is coupled to the output of the current measuring apparatus; a threshold value entry apparatus for entering at least a first threshold value for the setpoint value of the total current through at least the first inductance and the second inductance, wherein the drive circuit is designed to drive at least the first electronic switch and the second electronic switch taking into consideration the first threshold value as setpoint value. Various embodiments moreover relate to a method for operating at least a first discharge lamp and a second discharge lamp using such an electronic ballast.

BACKGROUND

In particular, the present invention relates to the problem that high-pressure and low-pressure discharge lamps require high voltages for starting. These voltages are generated by electronic ballasts with the aid of a series resonant circuit. In the case of electronic ballasts for two or more lamps, two or more parallel-connected load circuits are often used. In the case of electronic ballasts for two lamps, with reference to which the following invention is described by way of example, the bridge circuit therefore needs to be designed for twice the current than in the case of operation with a single discharge lamp. Generally, both load circuits do not have precisely the same resonant frequency. This can mean that one discharge lamp starts earlier than the other. If this happens, the current in the load circuit with the started discharge lamp is markedly lower. A starting controller which is provided in the electronic ballast continues to permit twice the current in comparison with the starting of a discharge lamp, however, in which case this current largely flows through the unloaded, started load circuit. This results in markedly higher starting voltages than is desirable in this circuit which is running off load.

One procedure for largely gaining control of this problem is known from EP 1 337 133 A2. This application relates to an operating circuit for a low-pressure gas discharge lamp, in which a digital controller is designed in such a way that it triggers shutdown operations of a safety shutdown device for excessive currents by gradually lowering the operating frequency in the starting operation, in order thereafter to slightly increase the operating frequency in a renewed starting attempt again. An attempt is thereby made to achieve overall starting by repeated pulse-like starting operations until shutdown operations or else by a continuous starting operation at a minimum frequency, at which no shutdown operation occurs.

However, problems associated with the solution are the fact that only the current is controlled there and a shutdown operation is triggered if this current is too high. Then, the starting operation is repeated. If this system is used in the case of electronic ballasts for two lamps, the abovementioned problems result. In order to prevent this, the load circuits and in particular the dielectric strength of the components, for example inductors, capacitors, diodes, have been selected to be correspondingly high. This is associated with high costs and is therefore undesirable.

SUMMARY

Various embodiments develop an electronic ballast as mentioned at the outset or a method as mentioned at the outset in such a way that it is possible to dimension the components involved for lower voltages.

Various embodiments are based on the knowledge that this can be achieved if the electronic ballast continues to have a starting detection apparatus for detecting whether one of the discharge lamps has started. In this case, the drive circuit includes a second input, which is coupled to the starting detection apparatus, wherein the threshold value entry apparatus is furthermore designed to enter a second threshold value for the setpoint value of the total current through at least the first inductance and the second inductance, wherein the second threshold value has a smaller magnitude than the first threshold value. Furthermore, the drive circuit is designed to drive at least the first switch and the second switch taking into consideration the first threshold value as setpoint value prior to detection of the starting of a discharge lamp by the starting detection apparatus, and taking into consideration the second threshold value after detection of the starting of a discharge lamp by the starting detection apparatus.

By virtue of this measure, a lower starting voltage is established at the remaining, undamped load circuit, in which the lamp has not yet started, than in the procedure known from the prior art. As a result, undesirably high starting voltages are avoided, and the components involved can be designed for lower voltages. This applies not only to the components of the resonant circuit, but also to further elements, for example the elements which are used for filament monitoring.

A preferred embodiment is characterized by the fact that the drive circuit furthermore includes a comparator, which is designed to compare the actual value of the total current through at least the first inductance and the second inductance with the respective setpoint value of this current. For example, the microcontroller AT90PWM2 by Atmel can be used as the drive circuit which includes a comparator. By using a comparator, the maintenance of the setpoint value can be monitored very precisely. This makes it possible to realize precise and inexpensive dimensioning of the components involved.

Preferably, the starting detection apparatus includes an apparatus for power measurement, which is designed to determine a variable which has been correlated with the power output at the at least first terminal and second terminal. In contrast to the starting detection by virtue of evaluation of the current through the bridge circuit, as is practiced in EP 1 337 133 A2, for example, the measurement of the power provides more reliable information regarding whether one of the lamps involved has started or not.

Further preferably, the drive circuit is designed to regulate the actual value of the total current by varying the frequency of the signal, with which at least the first electronic switch and the second electronic switch are driven. Preferably, in this case the drive circuit is furthermore designed to reduce the frequency of the signal, with which at least the first electronic switch and the second electronic switch are driven, after detection of the starting of a discharge lamp. This procedure is described in the applications with the application numbers PCT/EP2006/066691 dated Sep. 25, 2006 and in EP 06 012 770.1 dated Jun. 21, 2006, the disclosure content of which is incorporated by reference in the disclosure content of the present application.

The drive circuit of an electronic ballast according to the invention is in particular designed in such a way that switchover from the first to the second threshold value can take place in a period of time which is at most 1 ms, preferably at most 200 μs. The wording "taking into consideration the first or second threshold value" takes into account the fact that, in practice, the respective threshold value can be slightly exceeded since preferably only the current through the lower electronic switch when realizing the bridge circuit by means of a half-bridge is evaluated for the current measurement. In particular, it should also be taken into consideration that, although the driving by the drive circuit can be reset very quickly when the threshold value is reached, there is still in practice a certain, finite time span, with the result that, once it has been established that the threshold value has been reached, a further, slight current increase is still possible before the drive circuit is reset for a renewed starting operation or for starting the second discharge lamp to a predeterminable value, in particular a frequency value. Nevertheless, the components involved can be designed very precisely and therefore inexpensively as regards a very small overshoot of the threshold value which is to be expected.

In a preferred embodiment, the second threshold value is at most 80%, preferably at most 75%, of the first threshold value. As a result, firstly impermissibly high currents are avoided, and secondly very quick starting of the as yet unstarted load circuit is made possible.

The preferred embodiments proposed with reference to an electronic ballast according to the invention and the advantages thereof are also relevant, where applicable, for a method according to the invention.

BRIEF DESCRIPTION OF THE DRAWING(S)

An exemplary embodiment of an electronic ballast according to the invention will be described in more detail below with reference to the attached drawing. Said drawing shows a schematic illustration of an exemplary embodiment of an electronic ballast according to the invention.

DETAILED DESCRIPTION

The following detailed description refers to the accompanying drawings that show, by way of illustration, specific details and embodiments in which the invention may be practiced.

The figure shows a schematic illustration of the design of an electronic ballast according to the invention for operating a first discharge lamp La1 and a second discharge lamp La2. On the input side, the ballast comprises a first terminal E1 and a second terminal E2 for connection to a system voltage UN. Connected thereto is a block 10, which includes a rectifier and components for EMC protection. This is followed by a step-up converter 12, which includes an inductance L1, a switch S1, a diode D1 and a capacitor C1. At the output of the ballast, the so-called intermediate circuit voltage UZW is provided firstly at a voltage divider R1, R2, and secondly at the two switches S2, S3 in a half-bridge. The signal tapped off at the resistor R2 is fed to a unit 14 of a microcontroller 16, with the unit being used for PFC (Power Factor Correction), For this purpose, in particular the switch SI of the step-up converter 12 is driven in a manner which is known to a person skilled in the art in respect of the amplitude level of the voltage UZW, which amplitude level is sensed by the resistor R2.

The switches S2, S3 in the half-bridge are driven via a driving generator 18 of the microcontroller 16. The half-bridge center point HB is coupled to a first load circuit and a second load circuit via a coupling capacitor C2. The first load circuit includes the abovementioned lamp La1 and a series resonant circuit, which includes an inductance L2 and a capacitor C3. The second load circuit includes the lamp La2 and a series resonant circuit, which includes an inductance L3 and a capacitor C4.

A shunt resistor R3 is used for measuring the current through the lower switch S3 in the half-bridge. For this purpose, the voltage drop across the resistor R3 is transmitted to an apparatus 20 for power measurement via a nonreactive resistor R4 and a capacitor C4, which are used for averaging. In this case, the known intermediate circuit voltage $U_{ZW}$ is taken into consideration, in addition to the current, for determining the power.

The apparatus 20 for power measurement is coupled on the output side to a control circuit 22, which fulfils two functions. It includes a threshold value entry apparatus, which enters a threshold value for the setpoint value of the total current through the first inductance L2 and the second inductance L3. This threshold value varies as regards whether neither of the two lamps La1, La2 has started yet or whether one of the two lamps La1, La2 has already started. In the event that one of the lamps La1, La2 has already started, the threshold value entered by the control circuit 22 has a markedly smaller magnitude than in the event that neither of the two lamps La1, La2 has yet started.

The threshold value entered in each case as setpoint value is compared with the present actual value in a comparator 24 of the microcontroller 22.

The control circuit 22 furthermore serves the purpose of predetermining a frequency for the driving generator 18, at which frequency the switches S2, S3 of the bridge circuit are driven. The control circuit 22 is in particular designed to further reduce the frequency of the signal, with which the switches S2, S3 are driven, after detection of the starting of one of the discharge lamps La1, La2.

As regards operation: the driving generator 18 drives the switches S2, S3 starting at a starting frequency. This is reduced gradually, with the current which is measured across the shunt resistor R3 being compared continuously with a first threshold value via the comparator 24. If this threshold value is reached, the starting operation is interrupted and started again at the starting frequency. If the reduction in the frequency results in starting of one of the two discharge lamps La1, La2, however, this is detected via the apparatus 20 for power measurement, whereupon the control circuit 22 provides a threshold value with a smaller magnitude to the comparator 24. If a further reduction in the frequency applied to the switches S2, S3 by the driving generator 18 results in starting of the second discharge lamp, the starting operation is ended. However, if the reduction in the frequency does not result in starting of the second discharge lamp, the frequency is reduced until the comparator 24 establishes that the second threshold value, which has a smaller magnitude, has been reached.

If the second discharge lamp then does not start within a time of preferably 100 ms, the electronic ballast shuts down. As a result of a system reset, a new starting attempt can be started.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An electronic ballast for operating at least a first discharge lamp and a second discharge lamp, the electronic ballast comprising: a bridge circuit, which comprises at least a first electronic switch and a second electronic switch, wherein the input at the bridge circuit is coupled to a DC supply voltage, wherein the output of the bridge circuit is coupled to a first terminal for a first discharge lamp and a second terminal for a second discharge lamp, wherein the first terminal and the second terminal are connected in parallel with respect to the output of the bridge circuit; at least a first starting apparatus and a second starting apparatus, which each comprise an inductance, which is arranged in series with the respective discharge lamp, and a capacitance, which is arranged in parallel with the respective discharge lamp; a current measuring apparatus, which is designed to provide a signal at its output, said signal being correlated with the actual value of the total current through the at least first inductance and second inductance; and a drive circuit comprising at least a first output and a second output for driving at least the first electronic switch and the second electronic switch, a first input, which is coupled to the output of the current measuring apparatus; a threshold value entry apparatus for entering at least a first threshold value for the setpoint value of the total current through at least the first inductance and the second inductance; wherein the drive circuit is designed to drive at least the first electronic switch and the second electronic switch taking into consideration the first threshold value as setpoint value; a starting detection apparatus for detecting whether one of the discharge lamps has been started; wherein the drive circuit comprises a second input, which is coupled to the starting detection apparatus, wherein the threshold value entry apparatus is furthermore designed to enter a second threshold value for the setpoint value of the total current through at least the first inductance and the second inductance, wherein the second threshold value has a smaller magnitude than the first threshold value; and wherein the drive circuit is designed to drive at least the first electronic switch and the second electronic switch taking into consideration the first threshold value as setpoint value prior to detection of the starting of a discharge lamp by the starting detection apparatus, and taking into consideration the second threshold value as setpoint value after detection of the starting of a discharge lamp by the starting detection apparatus.

2. The electronic ballast as claimed in claim 1, wherein the drive circuit furthermore comprises a comparator, which is designed to compare the actual value of the total current through at least the first inductance and the second inductance with the respective setpoint value of this current.

3. The electronic ballast as claimed in claim 1, wherein the starting detection apparatus comprises an apparatus for power measurement, which is designed to determine a variable which has been correlated with the power output at the at least first terminal and second terminal.

4. The electronic ballast as claimed in claim 1, wherein the drive circuit is designed to regulate the actual value of the total current by varying the frequency of the signal, with which at least the first electronic switch and the second electronic switch are driven.

5. The electronic ballast as claimed in claim 4, wherein the drive circuit is designed to further reduce the frequency of the signal, with which at least the first electronic switch and the second electronic switch are driven, after detection of the starting of a discharge lamp.

6. The electronic ballast as claimed in claim 1, wherein the drive circuit is designed to perform a switchover from the first to the second threshold value over a period of time which is at most 1 ms.

7. The electronic ballast as claimed in claim 6, wherein the drive circuit is designed to perform a switchover from the first to the second threshold value over a period of time which is at most 200 μs.

8. The electronic ballast as claimed in claim 1, wherein the second threshold value is at most 80% of the first threshold value.

9. The electronic ballast as claimed in claim 8, wherein the second threshold value is at most 75% of the first threshold value.

* * * * *

UNITED STATES PATENT AND TRADEMARK OFFICE

CERTIFICATE OF CORRECTION

PATENT NO. : 8,441,200 B2
APPLICATION NO. : 12/741833
DATED : May 14, 2013
INVENTOR(S) : Busse et al.

It is certified that error appears in the above-identified patent and that said Letters Patent is hereby corrected as shown below:

In the Specification

In column 4, line 14: Replace "," by "."

In column 4, line 15: Replace "SI" by "S1"

Signed and Sealed this
Twenty-ninth Day of April, 2014

Michelle K. Lee

Michelle K. Lee
*Deputy Director of the United States Patent and Trademark Office*